US005332108A

United States Patent [19]

Blass

[11] Patent Number: 5,332,108

[45] Date of Patent: Jul. 26, 1994

[54] SHELVING/DISPLAY SYSTEM

[75] Inventor: Clive J. Blass, Edgware, Great Britain

[73] Assignee: Cil Shopfitters Ltd., London, Great Britain

[21] Appl. No.: 923,973

[22] PCT Filed: Mar. 19, 1991

[86] PCT No.: PCT/GB91/00420

§ 371 Date: Sep. 18, 1992

§ 102(e) Date: Sep. 18, 1992

[87] PCT Pub. No.: WO91/14388

PCT Pub. Date: Oct. 3, 1991

[30] Foreign Application Priority Data

Mar. 19, 1990 [GB] United Kingdom ..... 9006152.4

[51] Int. Cl.[5] ..... A47F 5/00

[52] U.S. Cl. ..... 211/90; 211/94; 211/103; 211/105.1

[58] Field of Search ..... 211/90, 87, 94, 105.1, 211/103, 193

[56] References Cited

U.S. PATENT DOCUMENTS

| | | | |
|---|---|---|---|
| 2,992,743 | 7/1961 | Wing | 211/94 X |
| 4,160,570 | 7/1979 | Bridges . | |
| 4,508,231 | 4/1985 | Honickman . | |
| 4,634,010 | 1/1987 | Otema | 211/103 X |
| 4,869,378 | 9/1989 | Miller | 211/94 |
| 4,890,808 | 1/1990 | Ford | 211/105.1 X |
| 4,928,833 | 5/1990 | Huizenga | 211/94 X |
| 4,958,594 | 9/1990 | Swagerty | 211/103 X |
| 5,110,080 | 5/1992 | Rieman | 211/94 X |

FOREIGN PATENT DOCUMENTS

| | | |
|---|---|---|
| 222248 | 4/1924 | United Kingdom . |
| WO90/03751 | 4/1990 | World Int. Prop. O. . |

*Primary Examiner*—Robert W. Gibson, Jr.
*Attorney, Agent, or Firm*—Wolf, Greenfield & Sacks

[57] ABSTRACT

A merchandising system comprises an anchor rail that is attached in a substantially horizontal position to a supporting surface, such as a wall. The anchor rail releasably supports a hanger that extends vertically to a position remote from the anchor rail. The hanger can be located at substantially any position horizontally along the anchor rail. The hanger is supported by the upright surface at a position remote from the anchor rail but is free of permanent attachment to the upright surface at this position so that it can be freely moved horizontally. The hanger includes an upright portion that extends substantially vertically and also includes a support arm that extends outwardly from the upright portion to support a shelf or other object thereon.

21 Claims, 5 Drawing Sheets

SHELVING/DISPLAY SYSTEM

FIELD OF THE INVENTION

The present invention relates to a shelving/display system, and more particularly but not exclusively to a system suited for use as a shop fitting item for display purposes. It can however also be used in offices, public or domestic buildings and d-i-y applications.

BACKGROUND OF THE INVENTION

One of the problems with display/shelving systems particularly those used in shops is that they are often based on arrangements where fixed uprights are screwed to the walls at pre-determined intervals. For instance, the uprights could be spaced apart on one meter centres. The problem with such fixed upright systems is that they are configured in such a way that they limit the lateral flexibility of the system and their installation can require structural or substantial building work which a shop owner may not want.

The aim of the invention is to provide a versatile shelving/display system which is not limited by its configuration to having its uprights or main supports in any pre-determined vertical positions.

It is an object of the invention to provide a shelving-/display system which is cheap and easy to manufacture and simple to install.

SUMMARY OF INVENTION

According to the invention, there is provided a shelving/display system comprising an anchor rail for attachment substantially horizontally to an upright surface such as a wall or partition, the rail being configured to receive releasable engagement means provided on a hanger whereby the hanger can be attached to the rail at any location along its length, the hanger comprising an upright portion which extends substantially vertically with respect to the rail when assembled therewith and a support arm extending outwardly therefrom.

Preferably the rail is formed as a metal extrusion and is of indeterminate length. It could however be made of wood or some other material. In use, the rail is attached to the vertical surface (eg a wall or partition) in a substantially horizontal disposition thereto at any convenient location. By way of example, a first rail might be attached to the wall or partition at a location say 2 meters above the floor and a second intermediate rail could be attached between the first rail and the floor say 1 meter above the floor.

The system can be used in any configuration depending on the purposes required of it. For instance, if it is to be used to display merchandise such as garments, a combination of hangers and shelves could be used, the garments being hung from the arm extending from each hanger and the shelves being formed by placing a board on the arms extending from a pair of hangers suspended on the horizontal rail.

Preferably the releasable engagement means on the hanger are at one end of the upright portion thereof but they can be located intermediate the ends if required.

In a preferred embodiment, the arm extends outwardly from the upright hanger portion intermediate its ends and substantially normal to the rail. It can however be provided at the bottom end of the upright portion if required. Conveniently, the arm and upright portion of the hanger include cooperating means whereby the position of the arm along the upright may be changed.

Preferably the cooperating means are operable to fix the arm in position relative to the hanger upright. The cooperating means can however comprise friction means or alternatively cooperating slots on the hanger upright which engage with a peg on the arm.

The rail is preferably a metal extrusion of any desired length and in the preferred embodiment includes a lip extending along its length which cooperates with the engaging means on the hanger to retain the hanger in the rail. Preferably, the rail is long enough so that several hangers and/or accessories can be suspended from it spaced along its length. For example, if the system is to be used for shop fitting purposes, the accessories could be any of the following: garment rail, shelf arm, lighting attachment, coat hook, display torso, mannequin, display board etc. If however, the system is to be used in a domestic application, then the accessories might be lighting attachments, a clock, a mirror, a notice bard, a plant holder, a peg or slot bard, a slat wall for messages/notes, a letter rack, an audio visual support-shelf. By using side cheeks or end panels, cupboards can be formed.

In the preferred embodiment, the lip projects upwardly from the rail along its front edge to leave a channel between the lip and the rear of the rail. Preferably the engaging means includes a hook portion which fits over the upstanding lip. In the preferred embodiment, the lip extends along the upper part of the rail, the lower part being formed to define a channel shaped to receive an insert therein such as a decorative anel, or alternatively it could include pricing or size information, etc.

In another embodiment, the rail includes a lip which extends downwardly therefrom, the engaging means on the hanger including an upstanding part which engages behind said lip to retain the hanger in the rail. Alternatively, the rail can be channel shaped in cross section and include a pair of facing lips defining a slot therebetween, the engaging means on the hanger including a head which can be fitted into said slot to engage the rear face of each lip and retain the hanger in the rail. Depending on the design of the rail, the engaging means can be hooked into the rail by upwardly pivoting the engaging means to fit into the slot and then lowering the engaging means once it is in the rail to take up its position in which the hanger is retained in the rail. Alternatively, the hanger can be inserted in the slot in the rail in a horizontal position and then pivoted through 90° into a vertical position to lock it in position. In another embodiment, the engaging means on the hanger include a spring loaded detent which corporates with the lip on the rail. It will be appreciated from the foregoing that numerous forms of engaging means are envisaged within the scope of the present invention and that the important aspect of the present invention is not so much the engaging means themselves but more the use of the horizontal rail from which one or more hangers or accessories can be suspended thereby giving excellent flexibility to the system.

Conveniently each hanger is shaped so as to be spaced from the upright surface when this is engaged with the rail, the hanger having at one least spacer attached thereto to cooperate with said upright surface and maintain the upright portion of the hanger generally parallel to said upright surface. Conveniently, the or each spacer is releasably attached to the hanger. It may be necessary to provide more than one spacer along the length of the hanger if the upright portion of the hanger is particularly long. In a preferred embodiment, the spacer has a body portion attached to the hanger into which a foot is threadingly fitted whereby its into distance with regard to the hanger upright can be varied thereby enabling the upright to be kept generally parallel to the support surface.

BRIEF DESCRIPTION OF THE DRAWINGS

Preferred embodiments of the invention will now be described, by way of example only, with reference to the accompanying drawings in which.

DETAILED DESCRIPTION OF THE PREFERRED EMBODIMENTS

Figure 1:
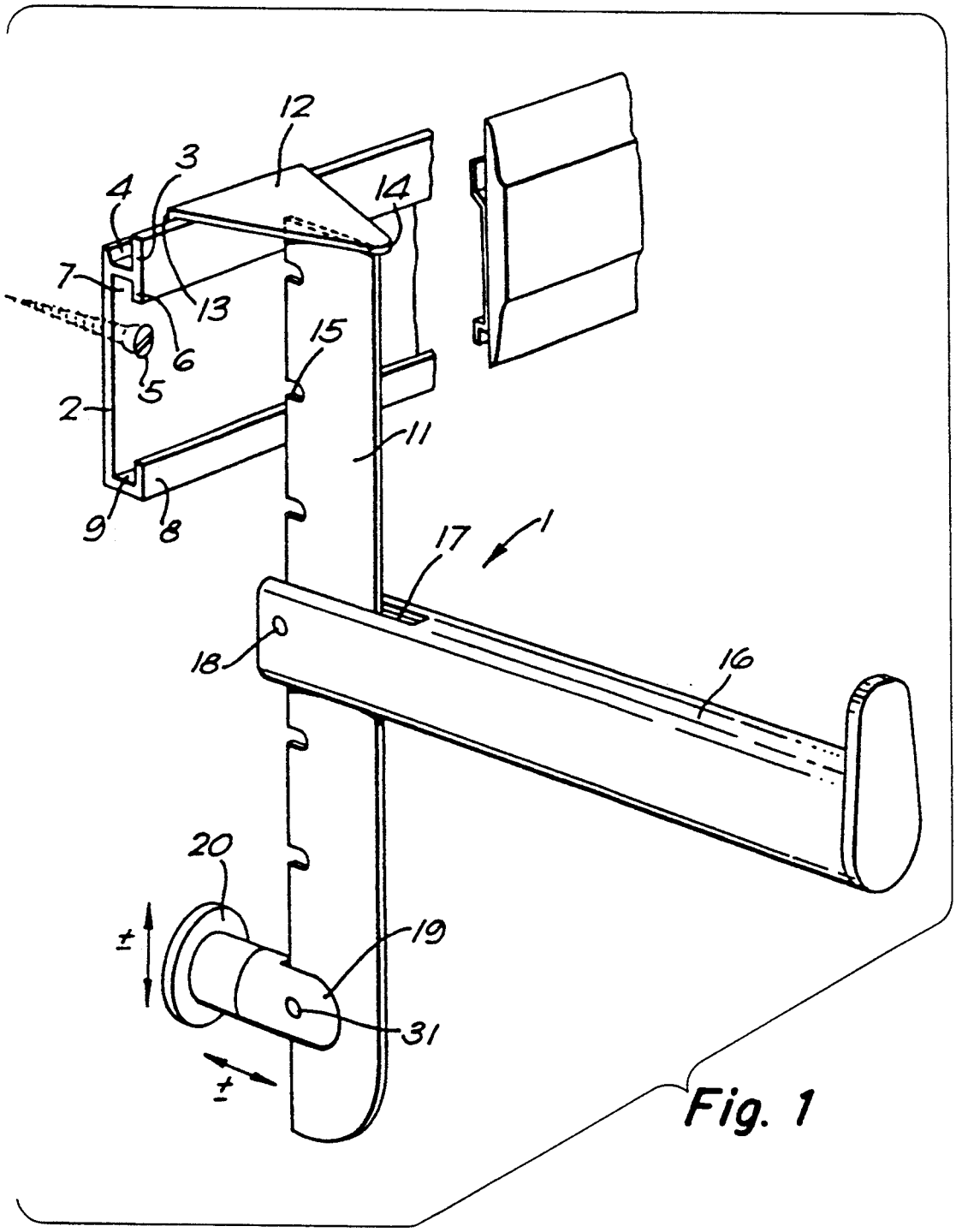
FIG. 1 is a perspective view of a shelving/display system of the invention which comprises an anchor rail, a hanger and a support arm.
Figure 2A:
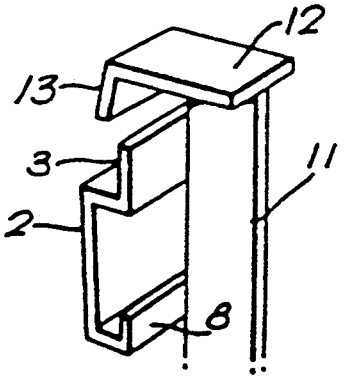
FIGS. 2A–2K are views showing various alternative ways of attaching a hanger of the invention to its anchor rail.
Figure 2B:
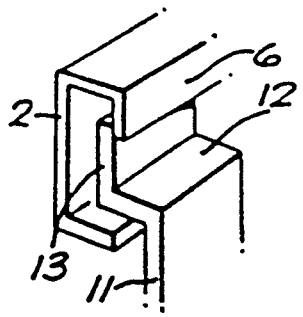
Figure 2C:
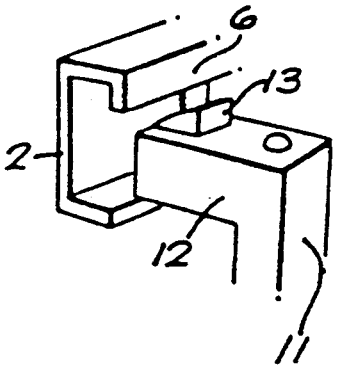
Figure 2D:
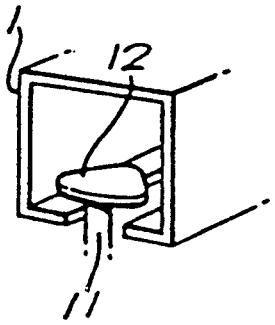
Figure 2E:
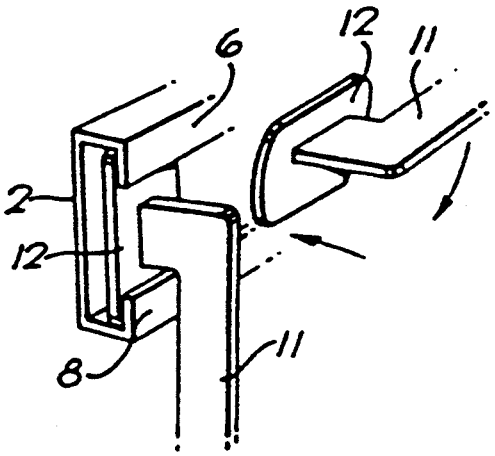
Figure 2F:
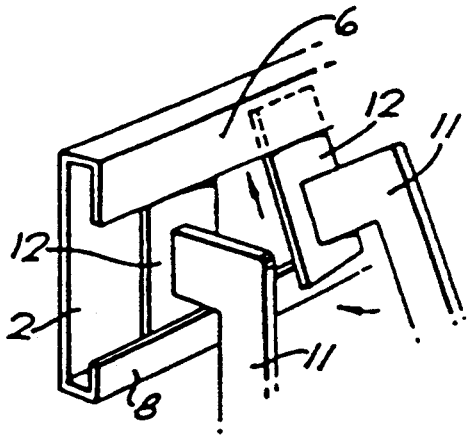
Figure 2G:
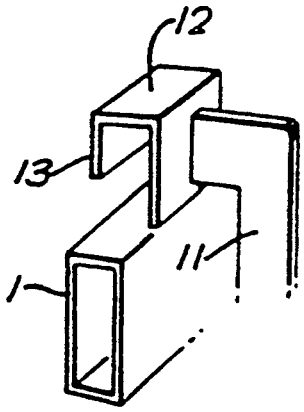
Figure 2H:
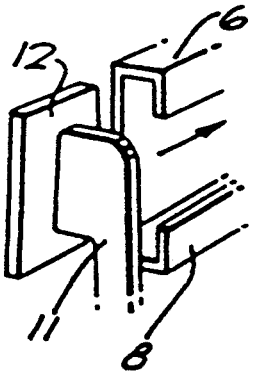
Figure 2I:
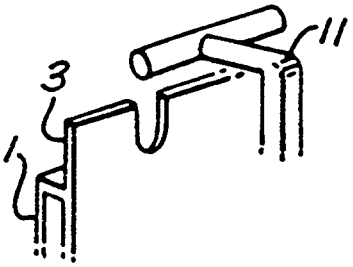
Figure 2J:
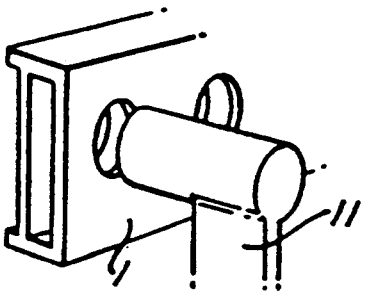
Figure 2K:
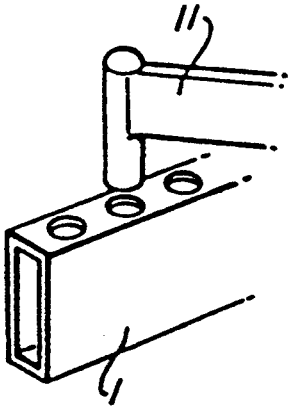

Referring to FIG. 1 of the drawings, there is shown a shelving/display system of the invention comprising an anchor rail 1, which is preferably a metal extrusion but it could be formed of another material if required. The rail can be of any suitable length (only part of a length is shown in FIG. 1) and includes a flat body section 2 whose upper region is formed as a T-section with lips 3 and 6. Upstanding lip 3 extending along the front edge of the rail to define a channel 4 between it and the surface (not shown) to which the anchor rail is mounted by means of screws 5, whereas lip 6 defines channel 7 which also extends along the whole length of the rail 1. The lower portion of the body part 2 includes an L-shaped portion having an upstanding lip 8 extending along the length of the rail which defines a channel 9 between said lip 8 and the body portion 2. A suitably shaped insert 10 can be fitted into the channels 7,9 and retained therein by means of the lips 6, 8. The insert 10 can be a decorative panel e.g. of wood or a plastics material to cover-up the screws 5. Alternatively, if the shelving/display system is to be used to display clothes or other articles, then the prices or size of the articles can be included on the front face 30 of the insert.

A hanging member 11 is suspended from the anchor rail 1 by engagement means, which in the illustrated embodiment, comprise plate 12 welded to the top of the hanger 11. A lip 13 extends downwardly from the plate 12 along its edge remote from apex 14. The hanger 11 has notches 15 provided along its edge adjacent the anchor rail 1. A support arm 16 with a slot 17 formed in one end thereof and a pin 18 extending across said slot is attached to the hanger 11 so as to extend outwardly therefrom generally at 90° to the rail 1. It will be appreciated from the arrangement shown in the drawings that the pin 18 will engage in the slot 15 thereby retaining it in position relative to hanger 11. Depending on which slot 15 is used, the height of the support arm 16 in relation to the rail 1 can be adjusted. A spacer 19 is fitted to the end of the hanger remote from the plate 12. This spacer includes a foot 20 which is preferably screw fitted into the spacer 19 so as to be adjustable in relation thereto. The spacer can be fitted to the hanger 11 at any location along its length either using a pin 31 as illustrated in FIG. 1 which engages with the slots 15 or by means of a friction fitting or other suitable means.

When the shelving/display system is assembled as illustrated in FIG. 1 the lip 13 on the front edge of the plate 12 at the top of the hanger 11 engages over the lip 3 at the front edge of the anchor rail 1. Hanger edge 21 containing the slots 15 rests against the front face of the lip 3 and also the lower lip 8 so said edge is spaced from the upright surface (not shown) to which the rail 1 is attached. The spacer 19 provides stability for the hanger 11 by filling in the gap A (see FIGS. 3 to 6) between hanger edge 21 and the wall or partition to which the anchor rail 1 is screwed. Another advantage of the spacer 19 is that any downward load applied to the arm 16 is split between the lip 13 and the spacer 19 so the load is spread along the length of the hanger 11 and transmitted to the upright surface through the spacer 19 and the lip 13 on the engaging plate 12. Thus, not all of the load on the arm 16 is taken by the lip 13 so the risk of the anchor rail 1 being torn out of the wall is substantially reduced.

The arrangements shown in FIGS. 2A–2K require little explanation but illustrate alternative ways in which the hanger 11 can engage with the rail 1, using lips 3, 6 and 13, flat body sections 2 and hanging members 11 as shown and described variously herein.

Figure 3:
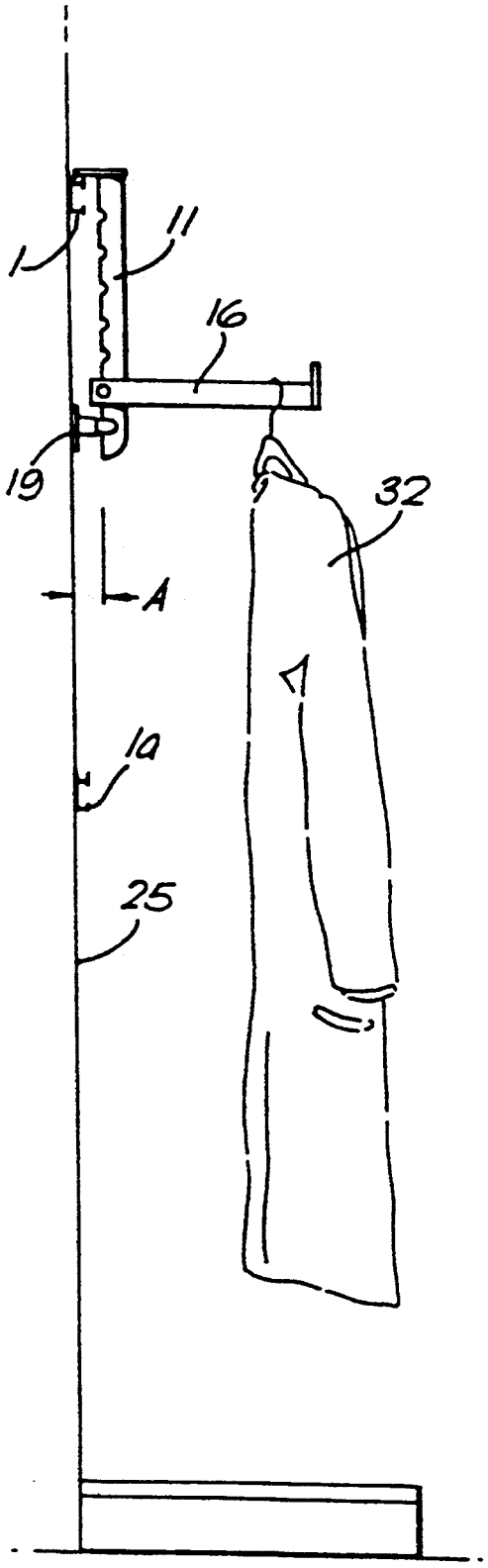
FIG. 3–6 show various assembled configurations or uses of the shelving/display system of the invention.

FIGS. 3–6 show possible configurations of the shelving or display system of the invention by way of example. Referring first to FIG. 3, it can be seen that the arrangement illustrated comprises an upper anchor rail 1 attached to a vertical surface such as a wall 25. A support arm 16 extends from hanger 11 and garments such as coats 32 are suspended from the arm 16.

Figure 4:
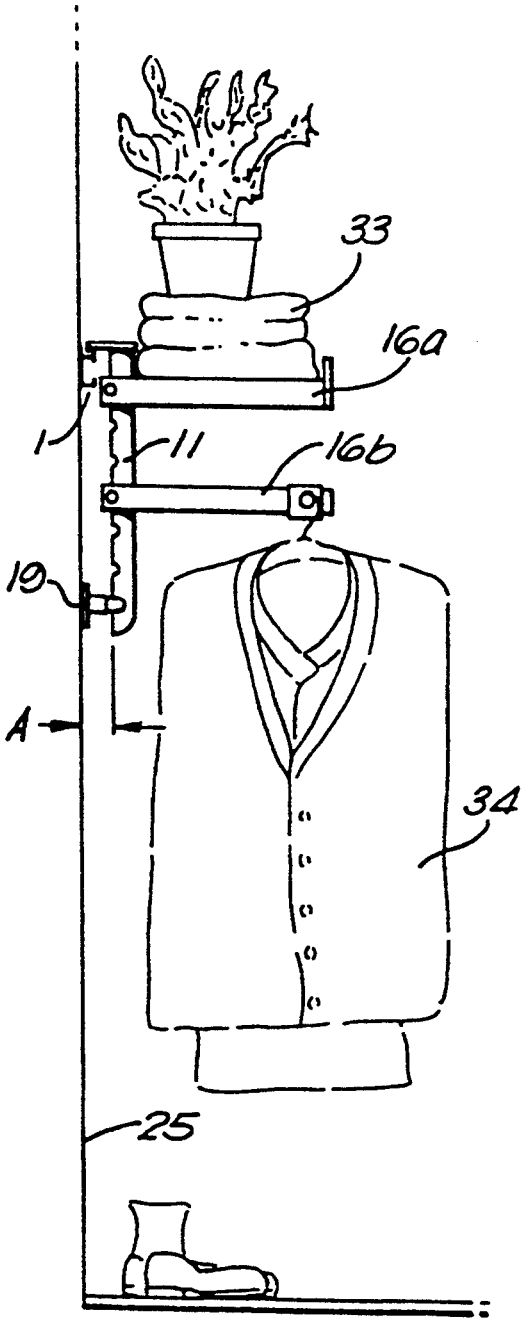

FIG. 4 shows an arrangement similar to FIG. 3 except that a pair of hangers 11 (only one is visible) are supported from the anchor rail 1 with upper arms 16*a* used to support a shelf therebetween on which items 33 can be displayed. In this arrangement, a second lower support arm 16*b* is attached to the hanger 11 so that garments 34 can be suspended therefrom.

Figure 5:
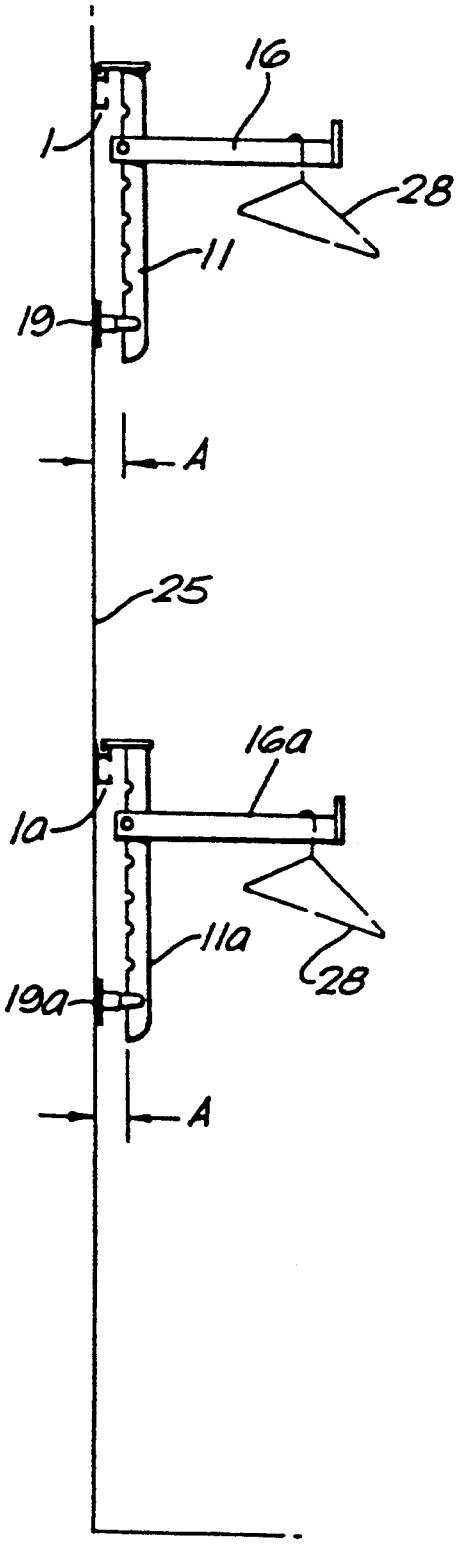
Figure 6:
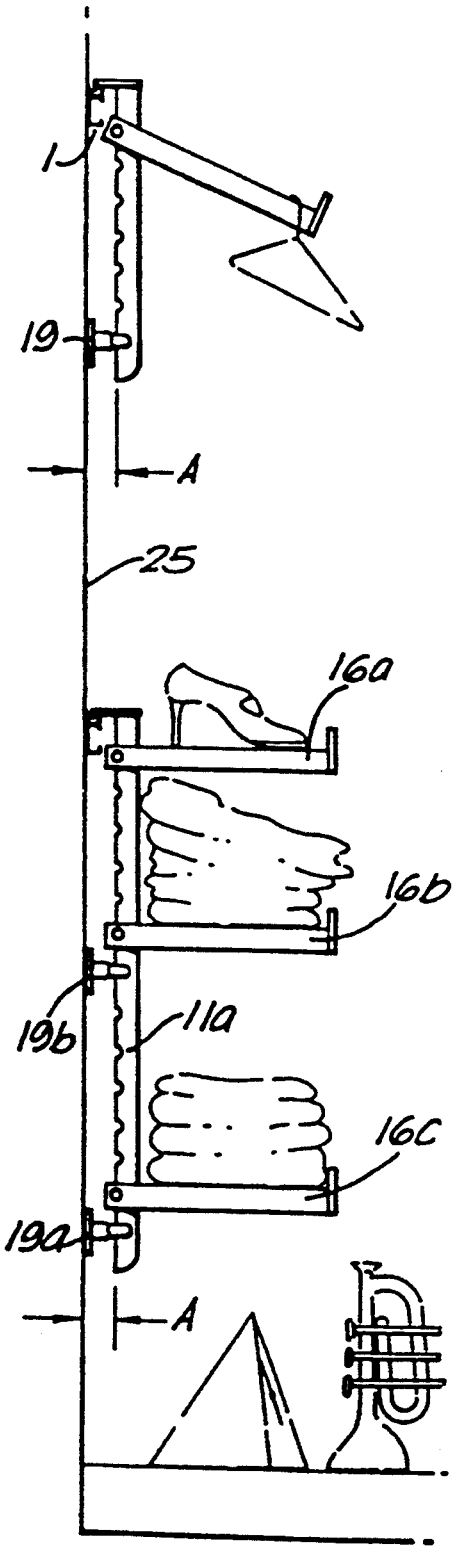

The arrangement illustrated in FIG. 5 shows upper hangers 11 supported on an upper anchor rail 1 and lower hangers 11*a* supported on lower anchor rail 1*a*. In the illustrated arrangement the upper and lower support arms 16, 16*a* act simply as rails to display garments on hangers 28.

The arrangement shown in FIG. 6 again uses an upper anchor rail 1 and a lower anchor rail 1*a* but pairs of hangers 11*a* are used on the lower rail 1*a* to provide a series of shelves 16*a*–16*e* on which merchandise can be displayed. In this illustrated arrangement, it will be noted that an additional spacer 19*b* is provided between the ends of the lower hangers 11*a* to provide additional support.

From the foregoing description, it will be appreciated that the shelving/display system of the present invention provides an extremely versatile system for erecting shelves or displaying garments or merchandise particularly as the hangers 11 can be attached to the anchor rail 1 at any position along its length. This gives great versatility to the system there are no vertical constraints on it. If hangers 11 are used in pairs then shelves can be assembled easily on them. Alternatively, the arms 16 can simply be used as hanging rails.

A substantial advantage of the present invention is that the shelving/display system is extremely simple to erect as all that is required is that the or each anchor rail of the selected length be attached to the wall, partition or other vertical surface in a horizontal postion. This is a simple job and, if necessary, a spirit level can be built in to the rail 1 as an integral part thereof to facilitate its mounting on the wall 25 in its correct orientation. Thereafter, any number of hangers and/or accessories can be suspended from the rail at any required location along its length thereby giving great flexibility to the system as it has no vertical constraints on it.

What is claimed is:

1. A merchandising system comprising: an anchor rail for attachment in a substantially horizontal disposition to a substantially vertical upright surface, said rail being constructed and arranged to receive a releasable engagement means located on at least one hanger so that the hanger is demountably attachable to the rail at any location along a length of the rail, wherein the hanger hangs freely from the rail in contact with the upright surface at a predetermined location thereon remote from the rail and the hanger being free of permanent attachment to the upright surface at the predetermined location, and the hanger being supported only by the anchor rail, the hanger comprising an upright portion which extends substantially vertically with respect to the rail when the hanger is attached to the rail and a support arm that extends outwardly from the upright surface.

2. A system as claimed in claim 1 wherein the releasable engagement means are located at one end 6*f* the upright portion of the hanger.

3. A system as claimed in claim 1 or claim 2 wherein the arm extends outwardly from the upright portion intermediate opposing ends of the upright portion substantially normal to the rail.

4. A system as claimed in claims 1 or 2 wherein the arm and the upright portion of the hanger each include cooperating locating means constructed and arranged so that the arm can be positioned at different locations intermediate the ends of the upright portion.

5. A system as claimed in claim 4 wherein the locating means are operable to locate and retain the arm in position relative to the upright portion.

6. A system as claimed in any one of claims 1 or 2 wherein the rail includes a lip along its length which cooperates with the engaging means on the hanger to retain the hanger in the rail.

7. A system as claimed in claim 6 wherein the lip projects upwardly from the rail and the engaging means includes a hook portion which engages with said upstanding lip.

8. A system as claimed in claim 6 wherein the lip extends along the upper part of the rail, the lower part of said rail being shaped to receive an insert therein.

9. A system as claimed in claim 6 wherein the lip extends downwardly from the rail, the engaging means on the hanger including an upstanding part which engages behind said lip to retain the hanger in the rail.

10. A system as claimed in claim 6 wherein the rail is channel shaped in cross section and includes a pair of facing lips defining a slot therebetween, the engaging means on the hanger having a head which can be fitted into said slot to engage the rear face of each lip and retain the hanger in the rail.

11. A system as claimed in claim 1 wherein the hanger is shaped so as to be spaced from the upright surface when it is engaged with the rail, the hanger having at least one foot attached thereto to cooperate with said upright surface and maintain the upright portion of the hanger generally parallel to said upright surface.

12. A system as claimed in claim 11 wherein the foot is releasably attached to the hanger.

13. A system as claimed in claim 12 where the foot includes means for adjusting a distance of the foot from the upright portion of the hanger so that a distance of the hanger from the upright surface can be adjusted thereby.

14. A system as claimed in claim 1 wherein the upright portion includes a plurality of notches disposed along a length thereof and wherein the support arm includes a pin for removably engaging each of the plurality of notches to secure the support arm on the upright portion relative to each of the plurality of notches.

15. A system as claimed in claim 14 wherein the upright portion includes a width in a direction taken toward and away from the wall surface and a thickness taken in the direction parallel to the direction of extension of the anchor rail and wherein the width is substantially larger than the thickness and wherein the notches are disposed along a rear thickness edge of the upright portion facing the wall surface.

16. A system as claimed in claim 15 wherein the support arm includes a cutout for surrounding sides of the upright portion taken along the width thereof and wherein the pin is located adjacent the rear thickness edge of the upright portion.

17. A merchandising system comprising:

an anchor rail constructed and arranged for attachment so that it extends substantially horizontally along a wall surface;

a hanger including an upright portion having a mounting bracket constructed and arranged to be releasably engaged by the anchor rail wherein the mounting bracket can be attached to, detached from and moved substantially horizontally along the anchor rail to be located at any position therealong, the upright portion extending downwardly from the anchor rail substantially perpendicularly to a direction of extension of the anchor rail;

a support extending from the upright portion of the hanger toward the wall surface located at a point along the upright portion remote from the anchor rail, the support engaging the wall surface free of any permanent attachment therebetween so that the hanger is freely movable substantially horizontally relative to the anchor rail and the hanger being free of engagement with a floor surface and being supported remote from the floor only by the anchor rail; and the hanger further comprising a support arm extending outwardly away from the wall surface in a direction substantially transverse to a direction of extension of the upright portion, the support arm being locatable at a plurality of vertical locations along the upright portion.

18. A system as claimed in claim 17 wherein the support includes an enlarged base for engaging the wall surface.

19. A system as claimed in claim 17 wherein the anchor rail includes a horizontal channel and wherein the hanger includes a lip for engaging the channel so that the hanger is movable horizontally along the channel to any location thereon.

20. A system as claimed in claim 17 wherein the upright portion includes a plurality of notches disposed along a length thereof and wherein the support arm includes a pin for removably engaging each of the plurality of notches to secure the support arm on the upright portion relative to each of the plurality of notches.

21. A system as claimed in claim 17 further comprising a second support, located on the upright portion, at a position remote from each of the support and the anchor rail for engaging the wall surface, the support being free of permanent attachment to the wall surface.

* * * * *